US007673945B1

(12) United States Patent
Riffel et al.

(10) Patent No.: US 7,673,945 B1
(45) Date of Patent: Mar. 9, 2010

(54) SAFETY HARNESS

(76) Inventors: Sheila M. Riffel, 1304 Brandywine St., Niles, MI (US) 49120; Warren N. Smith, 1304 Brandywine St., Niles, MI (US) 49120

( * ) Notice: Subject to any disclaimer, the term of this patent is extended or adjusted under 35 U.S.C. 154(b) by 0 days.

(21) Appl. No.: 12/102,315

(22) Filed: Apr. 14, 2008

(51) Int. Cl.
*A47D 15/00* (2006.01)
*A47C 15/00* (2006.01)

(52) U.S. Cl. ..... 297/485; 297/467; 297/468; 297/483; 297/256.17; 280/808; 182/3

(58) Field of Classification Search ..... 297/467, 297/468, 483, 484, 485, 256.17; 182/3; 280/33.993, 280/33.992, 808
See application file for complete search history.

(56) References Cited

U.S. PATENT DOCUMENTS 1,298,615 A * 3/1919 Wilkinson ..... 244/122 B
2,132,556 A * 10/1938 Blackshaw ..... 297/484
2,877,833 A * 3/1959 Boles ..... 297/485
4,939,824 A * 7/1990 Reed ..... 24/633
5,069,168 A * 12/1991 Roberson et al. ..... 119/770
5,203,613 A * 4/1993 Ward ..... 297/485
5,325,818 A * 7/1994 Leach ..... 119/770
5,378,046 A * 1/1995 Gordy et al. ..... 297/485
5,624,135 A * 4/1997 Symonds ..... 280/801.1
5,676,426 A * 10/1997 Herring ..... 297/484
5,927,235 A * 7/1999 Olaiz ..... 119/770
6,125,792 A * 10/2000 Gee ..... 119/770
6,405,685 B1 * 6/2002 Cox ..... 119/857
6,626,131 B2 * 9/2003 Moulton, III ..... 119/770
6,837,547 B2 * 1/2005 Delventhal et al. ..... 297/484
6,874,596 B2 * 4/2005 Zeissler et al. ..... 182/3
7,140,692 B2 * 11/2006 Stoll ..... 297/485
7,311,063 B2 12/2007 Goldberg
7,341,025 B1 * 3/2008 Streeter et al. ..... 119/857

* cited by examiner

*Primary Examiner*—Laurie K Cranmer
(74) *Attorney, Agent, or Firm*—Botkin & Hall, LLP

(57) ABSTRACT

This invention relates to a harness for securing a person to a supporting structure. The harness includes a pair of straps each having a first and second end, a back portion, a front portion, and a chest portion. The first end is looped over the front portion of each strap and attached to the front portion to form a first loop. The first loop is attached near each second end of both straps. A coupler is near the second end and spaced from where the coupler is attached to the straps. The coupler is separable and may be separated to allow said straps to be separated at the chest portion. The harness goes over both shoulders of a toddler, behind the back and the coupler fastens across the toddler's chest. This prevents a toddler from standing up when wearing the harness.

10 Claims, 7 Drawing Sheets

SAFETY HARNESS

BACKGROUND OF THE INVENTION

A toddler falling from a shopping cart or a high chair can result in serious injury, therefore preventing such falls is important. Attempts to prevent this usually involve some type of safety belt, however, such safety belts do not prevent a child from leaning forward or wiggling out. As a child gains motor skills he or she may be able to become free by releasing a safety belt. A safety harness that restrains the torso and is not easily released by a toddler will prevent such injuries.

SUMMARY OF THE INVENTION

This invention relates to a harness for securing a person to a supporting structure. The harness includes a pair of straps that each have a first and second end, a back portion, a front portion, and a chest portion. The first end is looped over the front portion of each strap and attached to the front portion to form a first loop. The first loop has an outer portion and an inner portion. The front portion of the straps continues into the back portion and the back portions of each strap are held adjacent to each other by a holder. The back portions continue into the chest portion and the chest portion terminates in a second loop. The second loop has a first end a second end, a front outer portion, a back outer portion and a middle portion that separates a front half of the second loop from a rear half of the second loop. The first end of the second loop has the middle portion folded between the front outer portion and the back outer portion so that the middle portion extends from the first end of the second loop to the second end of the second loop. The second end of the second loop is secured to a coupler. The second end of the strap is captured between the front inner portion and the front outer portion at the second end of the second loop. The outer portion of the first loop is retained in the front half of the second loop and the inner portion of the first loop is retained in the rear half of the second loop.

DETAILED DESCRIPTION OF INVENTION

Figure 3:
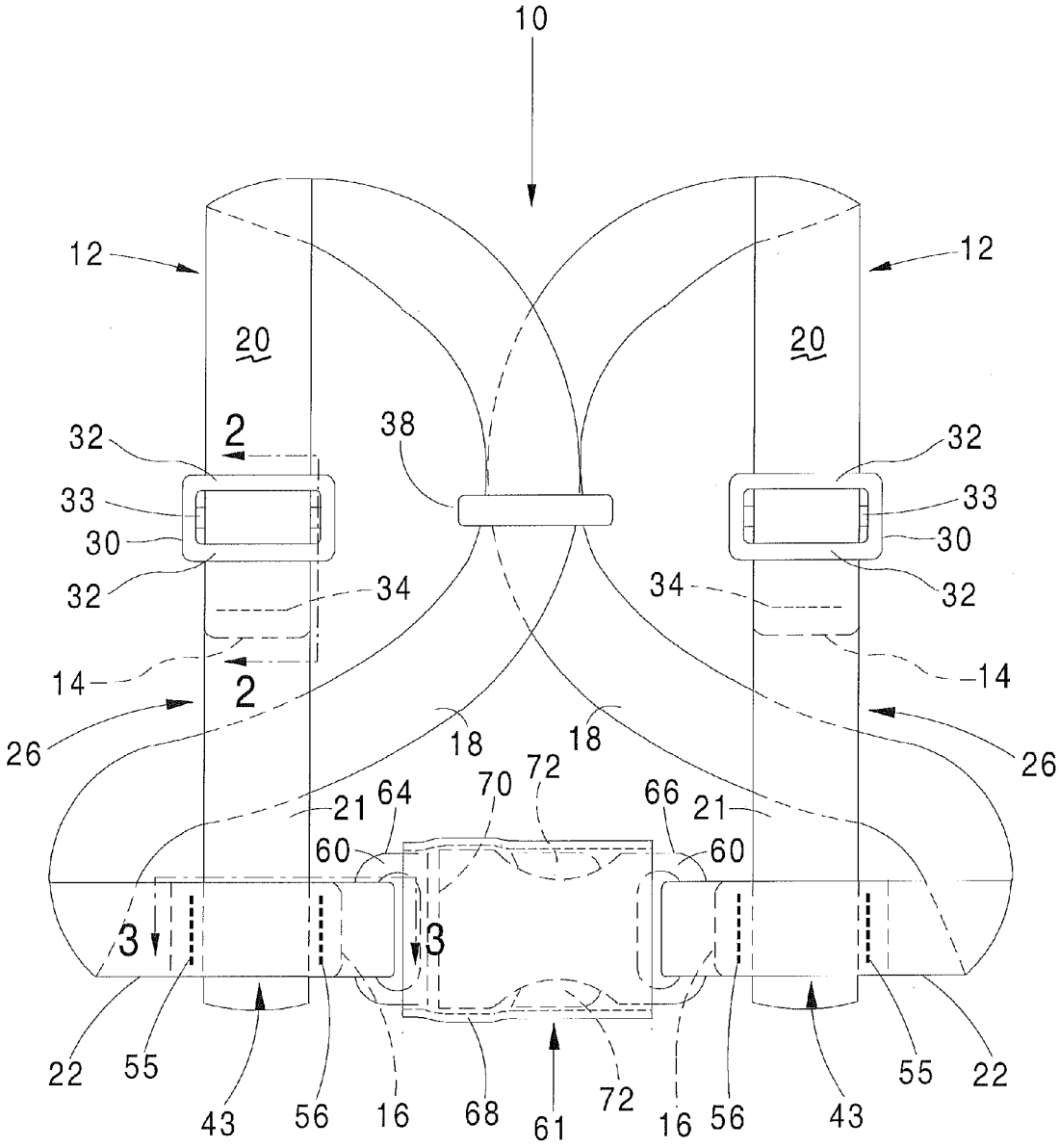
FIG. 3 is a front view of the harness shown in FIG. 1.

The safety harness 10 of this invention has a pair of straps 12 that have a first end 14, a second end 16, a back portion 18, a front portion 20 and a chest portion 22. The harness 10 is designed to be placed over a toddler so that the front portion 20 of the straps go over the shoulders of the toddler, then continue into the back portion 18 which are behind the toddler's back, and the chest portion 22 of the straps then emerge around the toddler's torso, as show in FIGS. 1 and 3.

Figure 5:
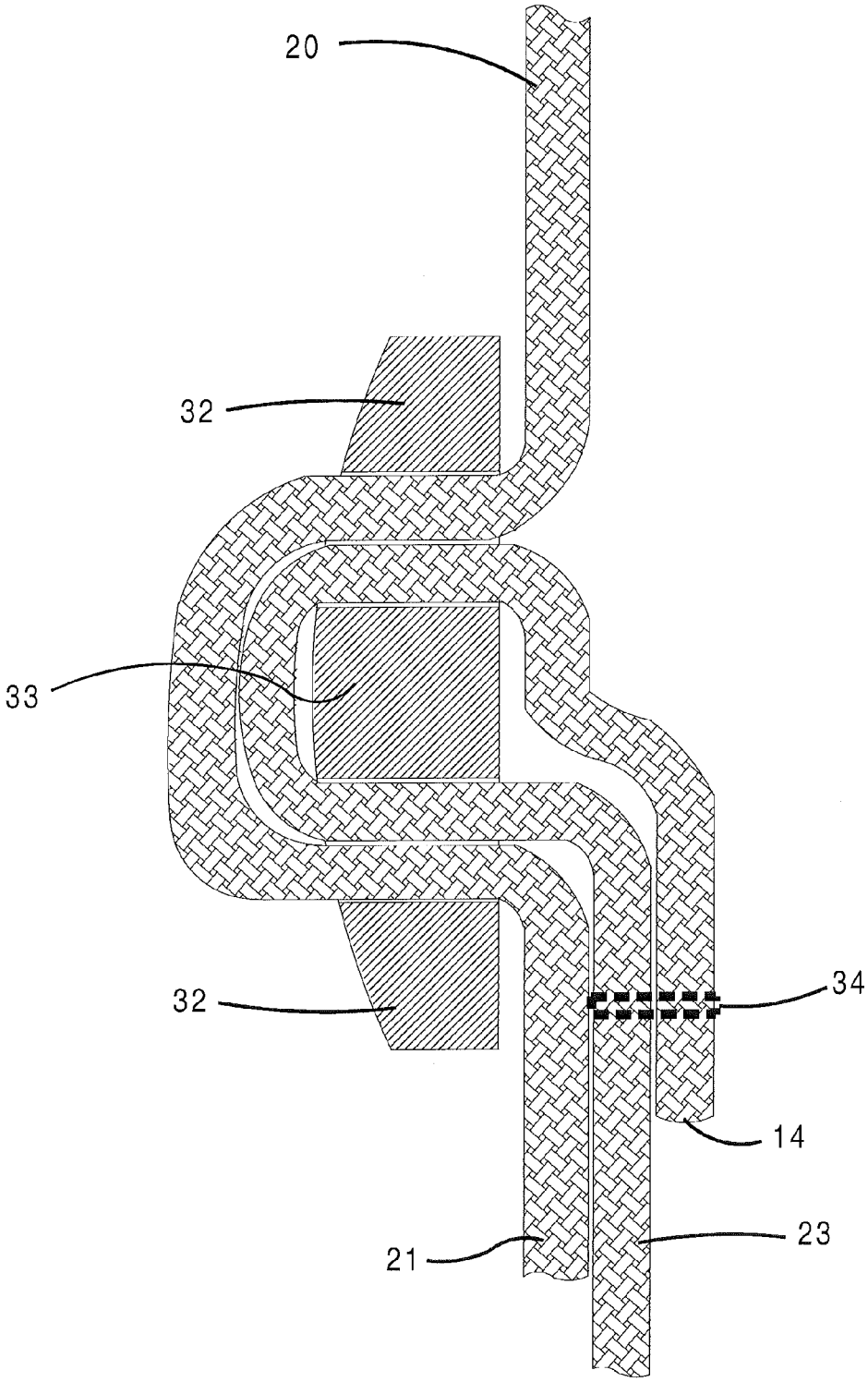
FIG. 5 is a sectional view of the three bar cleat.

The first end 14 of each strap is terminated by a three bar cleat 30. The three bar cleat 30 has end bars 32 and a middle bar 33 that is between the end bars 32. The first end 14 of the strap is looped around the middle bar 33 and stitched with stitches 34 to itself as shown in FIG. 5. The front portion 20 of each strap is then looped through the three bar cleat 30 so that the strap passes over the middle bar 33 and under the end bars 32. This forms a first loop 26 below the three bar cleat 30. The first loop 26 has an outer portion 21 that faces outward from the toddler the harness is to be used on, and an inner portion 23 that faces inward and contacts the chest of the toddler. Each three bar cleat 30 is slidable over the front portion of its corresponding strap 12, which allows adjustment of the overall length of each strap 12.

Figure 2:
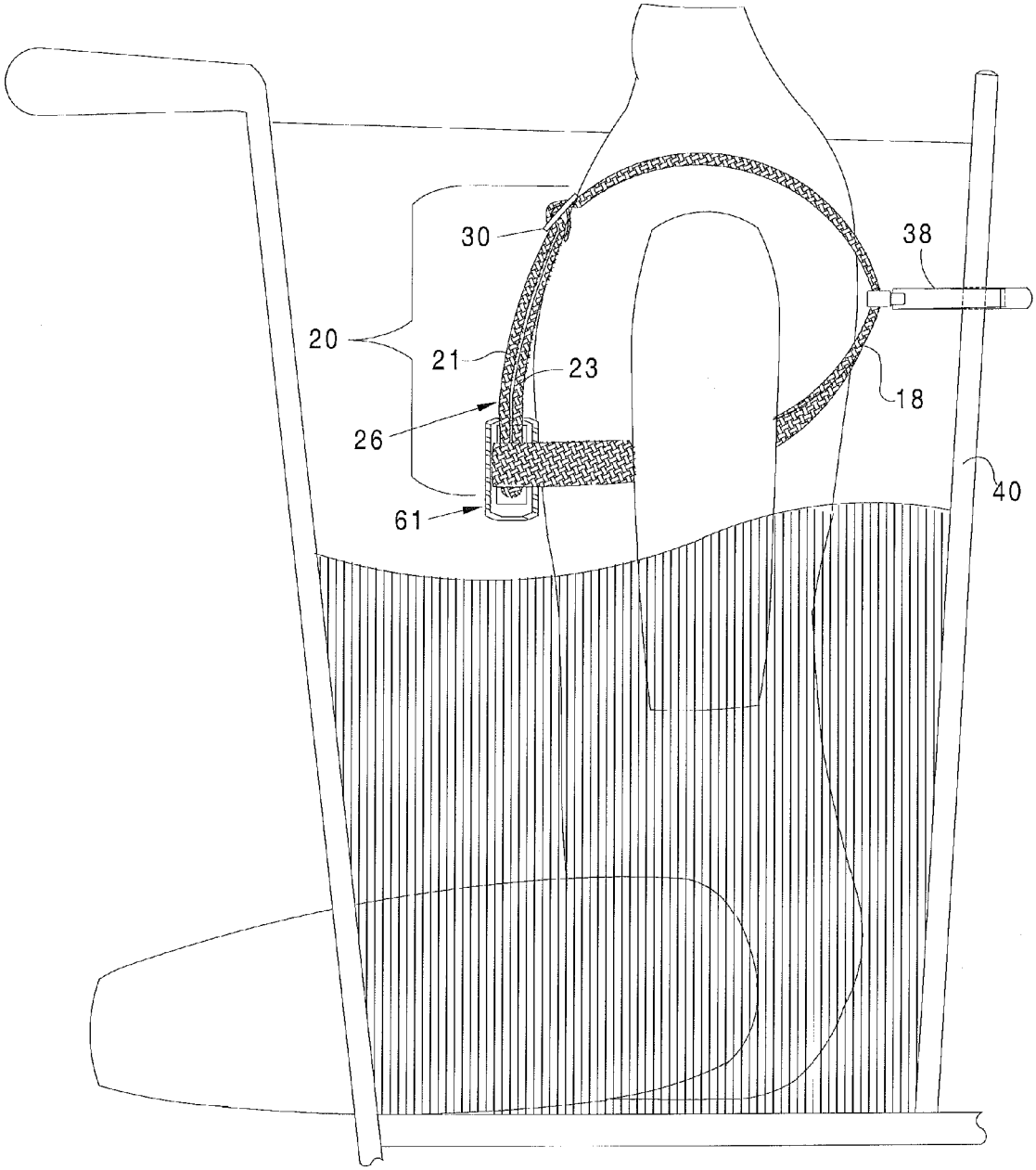
FIG. 2 is a side view of a toddler in a shopping cart in the harness shown in FIG. 1.

The back portions 20 of the straps 12 are slidably held together by a holder, which is a ring 38. The ring 38 also holds the straps 12 to the structure 40 that supports the toddler, as shown in FIG. 2. The structure may often be a shopping cart, or a high chair and is not limited to such items.

Figure 4:
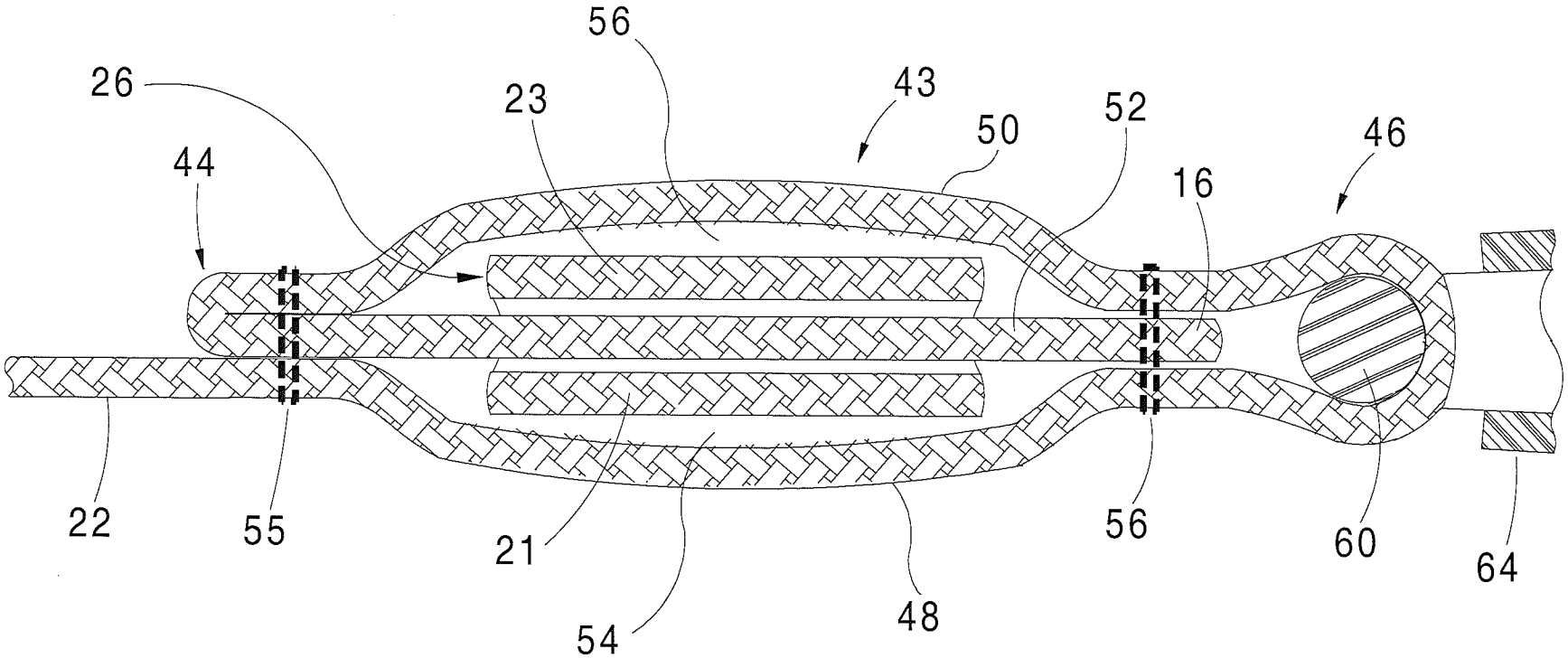
FIG. 4 is a sectional view taken about the line 3-3 in FIG. 1 which shows the second loop of the first embodiment.
Figure 6:
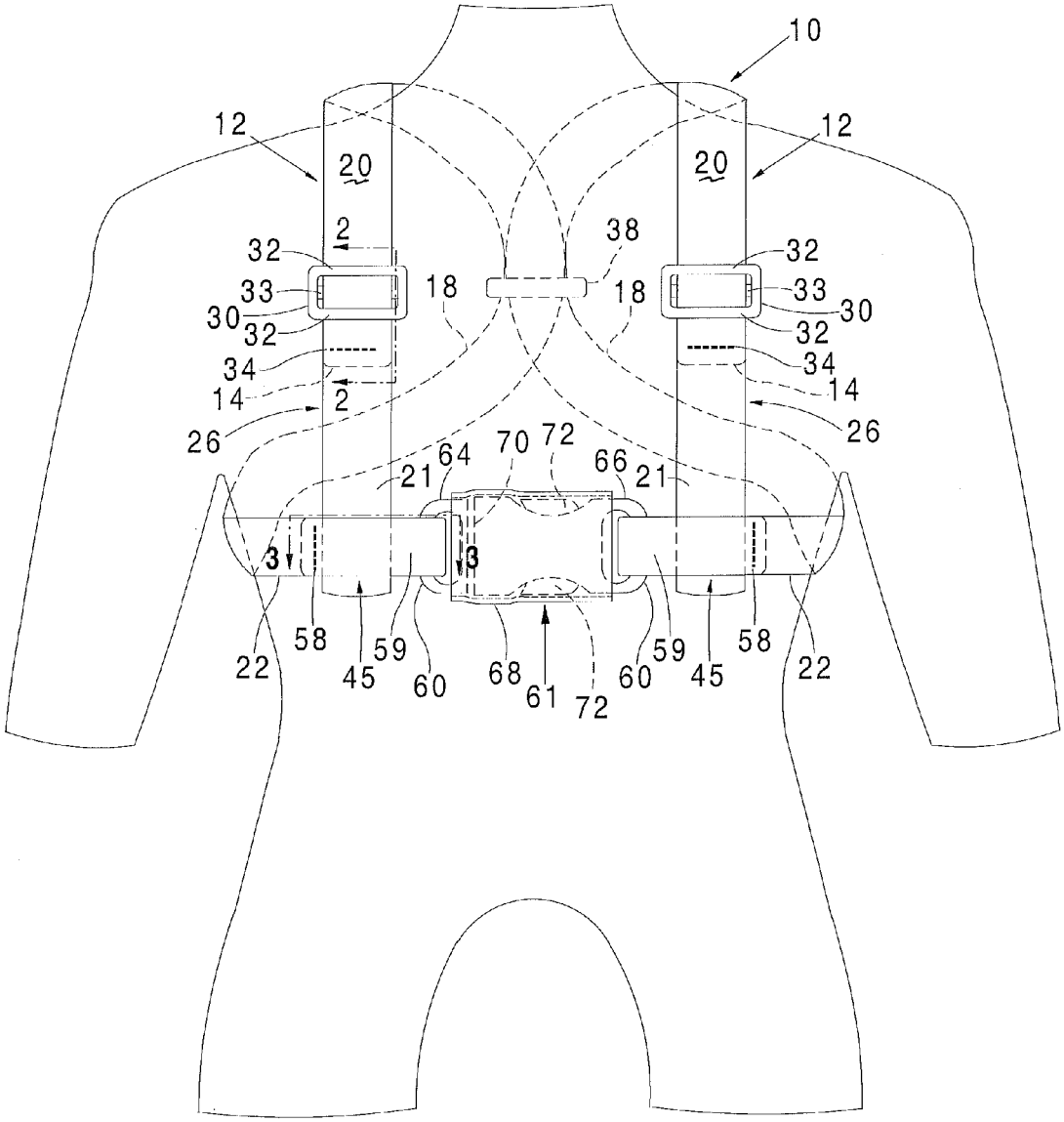
FIG. 6 is a front view of a second embodiment of the harness on a toddler.
Figure 7:
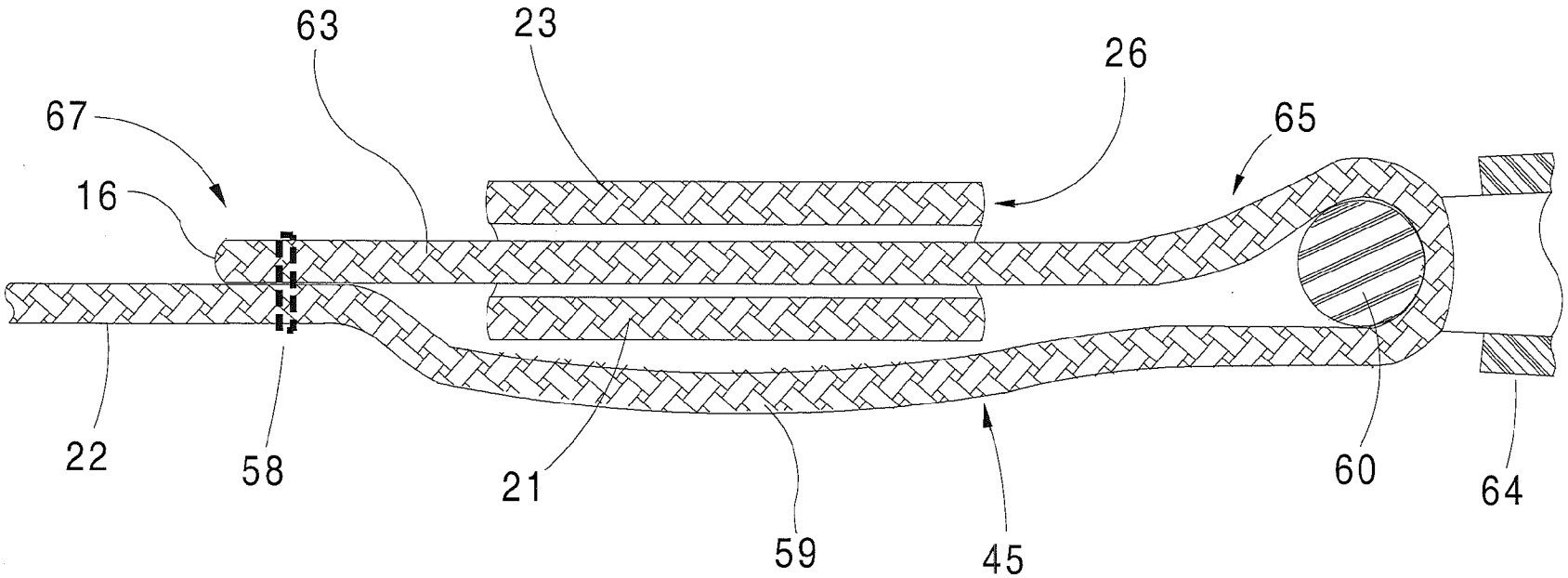
FIG. 7 is a sectional view of taken about the line 7-7 in FIG. 6 which shows the second loop of the second embodiment.

The straps 12 continue around to the toddler's chest and have a second loop 43 formed at their second ends 16. A first embodiment of the second loop 43 is shown in FIGS. 1-4 and a second embodiment of the second loop 45 is shown in FIGS. 6 and 7. A cross sectional view of the left second loop 43 of the first embodiment is shown in FIG. 4. In the first embodiment each second loop 43 has a first end 44 a second end 46 a front outer portion 48, a back outer portion 50 and a middle portion 52 that separates a front half 54 from a rear half 56 of the second loop 43. The first end 44 of the second loop 43 has the middle portion 52 folded between the front outer portion 48 and the back outer portion 50. Stitches 55 are placed through the first end 44 of the second loop 43 and the middle portion 52 continues to the second end 46 of the second loop 43. Stitches 56 are sewn through the strap 12 near the second end 46 to secure the second end 16 of the entire strap 12, as shown in FIG. 4. Each half of the second loop 54, 56 slidingly retains a portion 21, 23 of the first loop 26. The front half 54 of the second loop 43 retains the outer portion 21 of the first loop 26, and the rear half 56 of the second loop 43 retains the inner portion 23 of the first loop 26. This sliding relationship between the portions 21, 23 and the second loop 43 allows the portions 21, 23 of the strap to move relative to the second loop 43 when the three bar cleat 30 is moved along the strap 12 to adjust the length of the strap 12. The second loops 43 are folded in such a way that the multiple layers of each strap 12 are in close proximity providing shape and structure to the harness 10, which prevents it from becoming tangled within itself. A portion of the second loop 43 is closed with stitches 56 at the second end 46 of the second loop 43 to hold a bridge 60 of a coupler 61.

In the second embodiment of the second loop 45 that is shown in FIGS. 6 and 7, the second loop 45 is made more simply than in the first embodiment. Each second loop 45 is made by folding each strap 12 over itself and around a corresponding bridge 60, which is captured within the second loop 45. The end of each strap 16 is sewn to the strap 12 with stitches 58 near a first end 67 of each second loop 45. The second loop 45 has a inner portion 63 and an outer portion 59 formed from the strap 12 being folded over itself. The bridge 60 of the coupler 61 is captured near the second end 65 of the second loop 45. Portions 21, 23 of the first loop 26 encompass either the inner portion 63 or the outer portion 59. As shown in FIG. 7, the inner portion 63 of the second loop 45 is encompassed by the first loop 26. This means that the inner portion 23 of the first loop 26 will contact the toddler when he is in the harness 10. The portions 21, 23 of the first loop 26 are slidingly retained by the second loop 45, which is similar to the first embodiment shown in FIGS. 1-4. This allows the three bar cleat 30 to be moved to change the overall length of the strap 12.

Figure 1:
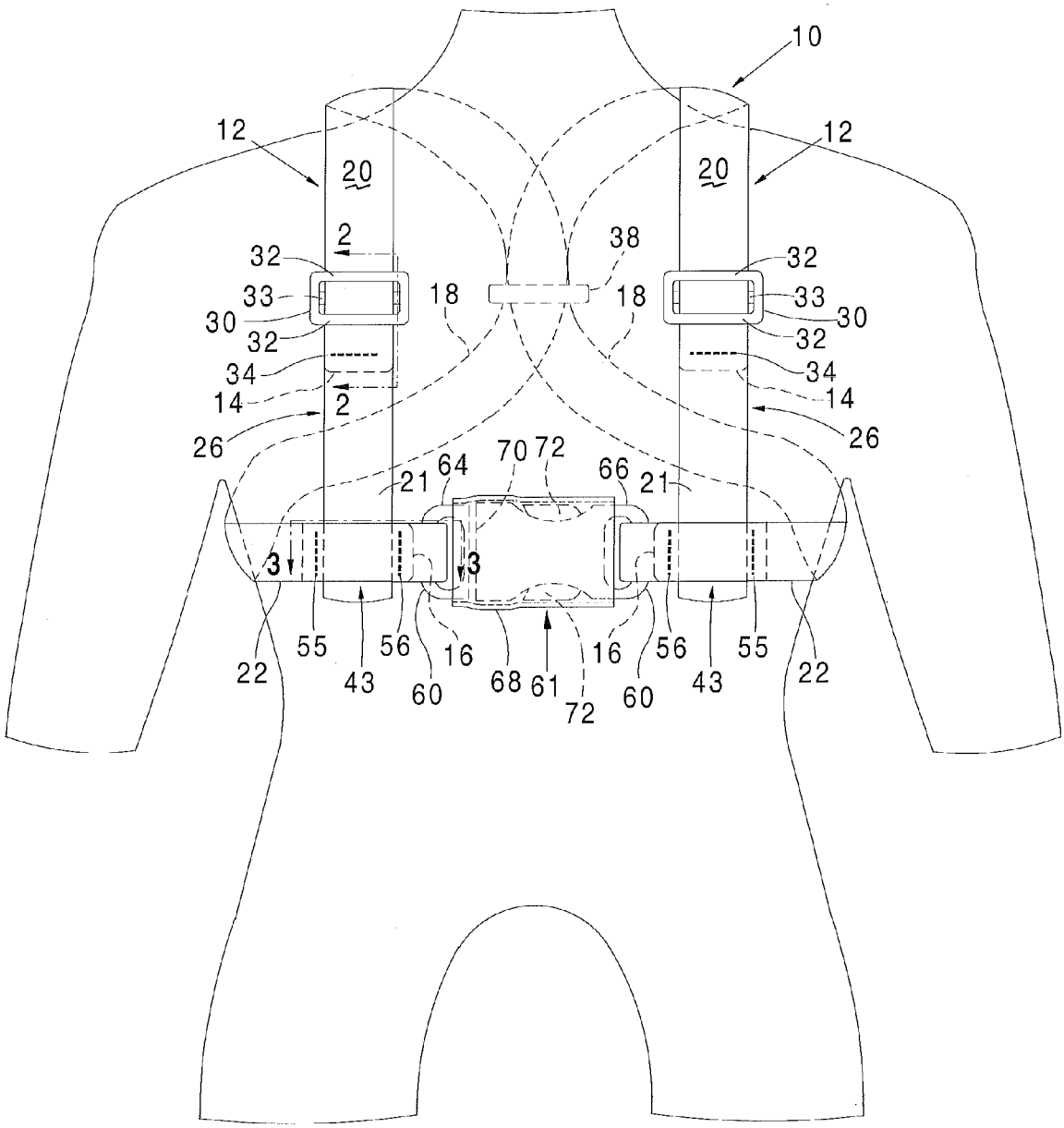
FIG. 1 is a front view of a first embodiment the harness on a toddler.

The coupler 61 has a male coupler part 64 and a female coupler part 66 that join the straps 12 together across the chest of a toddler placed in the harness 10. The male and female parts 64, 66 are releasably securable to each other and join the straps 12 together, as shown in FIG. 1. The male and female parts 64, 66 of the coupler 61 are covered by a covering 68 that hides the end 70 of the male coupler part 64, where the coupler parts 64, 66 join. The covering 68 is made of rubber or a similar material that provides a grippable surface and is flexible. The coupler parts 64, 66 are released by squeezing the covering 68 over tabs 72 that are on the male part 64 and pulling the male part 64 away from the female part 66. The covering hides the tabs 72 so that a toddler will not readily see how the coupler parts 64, 66 are separated. Additionally, the covering 68 makes the female coupler part 66 near its bridge 60 appear smaller than the male coupler part 64 near its bridge. This encourages a toddler, who might attempt to release the coupler parts 64, 66, to grab the female coupler part 66 and pull on the female coupler part 66 near its bridge 60, which will be ineffective to release the coupler parts 64, 66. This tendency of toddlers to pull a smaller end out of a larger end comes from their experiences, usually with automotive seat belts, that the smaller end is pulled from a larger receptacle.

The harness 10 is used by first securing the harness 10 to the structure 40 on which a toddler sits. The structure 40 shown in FIG. 2 is a shopping cart, but could be a high chair or stroller. The ring 38 is first attached to the structure 40. The ring 38 may be a releasable ring or may be permanently attached to the structure 40. With the ring 38 secured to the structure 40 the coupler 61 is separated and the front portions 20 of the straps 12 are placed over the toddler as shown in FIG. 2. With the straps 12 placed over the toddler, the coupler parts 64, 66 are joined. If adjustment is needed to tighten or loosen the harness 10 on the toddler, the three bar cleats 30 may be moved to tighten or loosen the harness as necessary 10. This configuration prevents the toddler from leaning forward and falling from where they are seated.

This invention is not limited to the details given, but may be modified within the scope of the following claims.

What is claimed is:

1. A safety harness for securing a person to a supporting structure, said harness comprising:

a pair of straps made of a continuous piece of material each said strap including a first and second end; a back portion, a front portion, and a chest portion, said first end being looped over said front portion of said strap and attached to said front portion of said strap to form a first loop, said first loop having an outer portion and an inner portion, said front portion of said straps continuing into said back portion and said back portions of each strap being held adjacent to each other by a holder, said back portion continuing into said chest portion, said chest portion terminating in a second loop including a first end, a second end, a front outer portion, a back outer portion and a middle portion that separates a front half of said second loop and a rear half of said second loop, said first end of said second loop having said middle portion folded between said front outer portion and said back outer portion so that said middle portion extends from said first end of said second loop to said second end of said second loop to define said front half and said rear half of said second loop, said second end of said second loop secured to a coupler, said outer portion of said first loop is retained in said front half of said second loop and said inner portion of said first loop is retained in said rear half of said second loop, said coupler containing coupler parts, each coupler part releasably joinable to a coupler part on the other strap.

2. A safety harness as claimed in claim 1, wherein said first loop includes a means for adjusting that changes the length of each said strap.

3. A safety harness as claimed in claim 2, wherein said holder is a ring adapted for securing said harness to a supporting structure to restrain a person relative to said structure.

4. A safety harness as claimed in claim 1, wherein said coupler includes a male end and a female end.

5. A safety harness as claimed in claim 4, wherein said male and female ends include a cover covering a portion where said male and said female ends join.

6. A safety harness for securing a person to a supporting structure, said harness comprising:

a pair of straps made of a continuous piece of material each said strap including a first and second end; a back portion, a front portion, and a chest portion, said first end being looped over said front portion of said strap and attached to said front portion of said strap to form a first loop, said first loop having an outer portion and an inner portion, said front portion of said straps continuing into said back portion and said back portions of each strap being held adjacent to each other by a holder, said back portion continuing into said chest portion, said chest portion terminating in a second loop including a first end, a second end, a front outer portion, a back outer portion and a middle portion that separates a front half of said second loop and a rear half of said second loop, said first end of said second loop having said middle portion folded between said front outer portion and said back outer portion so that said middle portion extends from said first end of said second loop to said second end of said second loop to define said front half and said rear half of said second loop, said second end of said second loop secured to a coupler and said second end of said strap being captured between said front outer portion and said back outer portion of said second loop, said outer portion of said first loop is retained in said front half of said second loop and said inner portion of said first loop is retained in said rear half of said second loop, said coupler containing coupler parts, each coupler part releasably joinable to a coupler part on the other strap.

7. A safety harness as claimed in claim 6, wherein said first loop includes a means for adjusting that changes the length of each said strap.

8. A safety harness as claimed in claim 7, wherein said holder is a ring adapted for securing said harness to a supporting structure to restrain a person relative to said structure.

9. A safety harness as claimed in claim 6, wherein said coupler includes a male end and a female end.

10. A safety harness as claimed in claim 9, wherein said male and female ends include a cover covering a portion where said male and said female ends join.

* * * * *